US005419058A

United States Patent [19]

Swain et al.

[11] Patent Number: 5,419,058

[45] Date of Patent: May 30, 1995

[54] AUTOMATED SUBSTRATE LOADING AND PHOTORECEPTOR UNLOADING SYSTEM

[75] Inventors: Eugene A. Swain, Webster; David J. Vadas, Penfield, both of N.Y.; Robert B. Parry, deceased, late of Rochester, N.Y., by Deborah A. Parry, administrator

[73] Assignee: Xerox Corporation, Stamford, Conn.

[21] Appl. No.: 29,643

[22] Filed: Mar. 11, 1993

[51] Int. Cl.[6] ..... F26B 11/00

[52] U.S. Cl. ..... 34/186; 34/236

[58] Field of Search ..... 34/236, 58, 218, 219, 34/202, 104, 105, 184, 186, 187; 414/222, 228, 588

[56] References Cited

U.S. PATENT DOCUMENTS

| | | | |
|---|---|---|---|
| 3,121,520 | 2/1964 | Gann | 34/105 |
| 4,035,926 | 7/1977 | Farfaglia | 34/105 X |
| 4,085,517 | 4/1978 | Thiel et al. | 34/105 |
| 4,313,266 | 2/1982 | Tam | 34/236 |
| 4,337,719 | 7/1982 | vander Griendt et al. | 118/46 |
| 4,456,417 | 6/1984 | Gerding | 414/22 |
| 5,012,595 | 5/1991 | Christian et al. | 34/236 |
| 5,032,052 | 7/1991 | Swain | 414/222 |
| 5,037,676 | 8/1991 | Petropoulas et al. | 427/294 |
| 5,038,707 | 8/1991 | Swain et al. | 118/58 |
| 5,074,735 | 12/1991 | Stock | 414/27 |
| 5,076,750 | 12/1991 | Mandotti | 414/222 |
| 5,076,751 | 12/1991 | Kafka | 414/282 |
| 5,079,854 | 1/1992 | Hammond et al. | 34/187 |
| 5,090,350 | 2/1992 | Hammond et al. | 118/50 |

*Primary Examiner*—Henry A. Bennett

*Attorney, Agent, or Firm*—Gary G. Heffernan; Zosan S. Soong

[57] ABSTRACT

A system for loading a sleeve-like substrate into a processing module is disclosed. The system engages and retains a sleeve-like substrate by utilizing a first load head of a robot. The first load head typically engages and removes the sleeve-like substrate from a conveyor. The first load head transfer the sleeve-like substrate to a processing station module within the system. A second load head of the robot removes the sleeve-like substrate from the processing station module and transfers the module to a movable support structure. The robot provides movement of first or second load heads from a first position to a second position to orient the sleeve-like member in alignment with the support structure. The support structure inserts the sleeve-like substrate into the processing chamber for further processing. The system is particularly adapted for use in a rotary atomization manufacturing system in which a photoreceptor is manufactured by processing the sleeve-like substrate.

14 Claims, 2 Drawing Sheets

AUTOMATED SUBSTRATE LOADING AND PHOTORECEPTOR UNLOADING SYSTEM

BACKGROUND OF THE INVENTION

1. Field of the Invention

This invention relates generally to an apparatus for loading, supporting and unloading members, and more specifically, the present invention is directed to an improved automated substrate loading and photoreceptor unloading system for loading, supporting and unloading substrates, optionally in combination with collars.

2. Description of the Prior Art

A photoreceptor is a processed substrate, often cylindrical or belt like, used in a xerographic apparatus. The substrate is coated with one or more layers of a photoconductive material, i.e., a material whose electrical conductivity changes upon illumination, to form a photoreceptor.

A vital requirement in assuring high quality images in the xerographic process is that the substrate be properly coated with the photoconductive material. The substrates are loaded onto one or more cylindrical mandrel assemblies supported by a movable structure. The movable structure and the substrates carried thereby typically move to several nearby processing stations, such as a cleaning station, a coating station, and a curing or drying station. This enables the substrate to be properly coated with the photoconductive material to form a photoreceptor. The photoreceptors are thereafter unloaded from the mandrel assemblies.

The processing time of substrates in a rotary manufacturing system can be costly. Altering the processing system to reduce the cost and time is desired but not always achievable. A loading system which could eliminate one or more of the processing station during loading of the substrates into the processing system without adversely affecting the loading time would be highly advantageous.

In addition, if the loading of the substrates and the unloading of the photoreceptors is done manually, there exist additional problems. The complicated manual movements, although usually less than a minutes time, are considered time inefficient and result in particulate contamination generated by the motion of the operator. In addition, manual movements are difficult to perform after constant repetition resulting in a decrease in the quality of the loading process during an extended time period.

There exists a need for a simple and time efficient system for substrate loading and photoreceptor unloading which improves the overall efficiency of the manufacturing system employed therein.

The following disclosures may be relevant to various aspects of the present invention:

- U.S. Pat No. 4,337,719; Patentee: Vander Griendt et al.; Issued: Jul. 6, 1982
- U.S. Pat. No. 4,456,417; Patentee: Gerding; Issued: Jun. 26, 1984
- U.S. Pat. No. 5,032,052; Patentee: Swain; Issued: Jul. 16, 1991
- U.S. Pat. No. 5,037,676; Patentee: Petropoulos et al.; Issued: Aug. 6, 1991
- U.S. Pat. No. 5,038,707; Patentee: Swain et al.; Issued: Aug. 13, 1991
- U.S. Pat. No. 5,074,735; Patentee: Stock; Issued: Dec. 24, 1991

- U.S. Pat. No. 5,076,750; Patentee: Mandotti; Issued: Dec. 31, 1991
- U.S. Pat. No. 5,076,751; Patentee: Kafka; Issued: Dec. 31, 1991
- U.S. Pat. No. 5,079,854; Patentee: Hammond et al.; Issued: Jan. 14, 1992
- U.S. Pat. No. 5,090,350; Patentee: Hammond et al.; Issued: Feb. 25, 1992
- Co-pending U.S. application Ser. No. 07/815,472; Applicant: Swain; Filed: Dec. 31, 1991
- Co-pending U.S. application Ser. No. 07/933,647; Applicants: Swain et al.; Filed: Aug. 24, 1992

The relevant portions of the foregoing disclosures may be briefly summarized as follows:

U.S. Pat. No. 5,076,751 discloses a reelroom newsprint roll handling apparatus and method. A conveyor transports a newsprint roll to the roll handling apparatus. The apparatus includes storage and retrieval machines having a roll carrier provided with an intermediate and upper pair of obliquely disposed telescoping arms. The upper pair of arms are equipped with pivoted article engaging pads for cradling engagement with the surface portions of a load disposed thereon. The arms are transversely movable into a plurality of storage bins. Each of the retrieval machines have a base mounted for travel longitudinally along an aisle extending adjacent and parallel to a row of the storage bins, and a vertically movable elevator, mounted to the base and supporting the roll carrier. The storage and retrieval machines independently move the base horizontally, the elevator vertically and the roll carrier transversely. The roll carrier is movable into and out of a selected storage bin to deposit a newsprint roll therein or to remove a newsprint roll therefrom.

U.S. Pat. Nos. 5,032,052 and 5,038,707, each disclose a modular apparatus for processing cylindrical and belt-like substrates in a dual planetary array. A transport vehicle is illustrated and described which transports a support structure having a planetary array of support arms carrying a planetary array of substrates thereon into a plurality of processing stations for cleaning, coating, curing, etc. One end of the modular apparatus is illustrated having a plurality of vertically oriented substrates on a flat surface. Loading of the substrates is described as being achievable by a programmed robot arm or manually.

U.S. Pat. Nos. 5,037,676, 5,079,854 and 5,090,350, each disclose a method and an apparatus for manufacturing drum and flexible belt charge receptors. A carousel rotatable to several different surrounding stations, including a substrate loading/unloading station and a plurality of processing stations, is disclosed. The carousel includes a plurality of support mandrels for receiving substrates thereon. Uncoated substrates are loaded onto the planetary array of mandrels either manually or via a programmed robot arm.

U.S. Pat. No. 5,076,750 discloses an apparatus for loading and unloading adhesive tape cores onto an adhesive tape roll making machines. The apparatus slideably receives thereon adhesive tape cores on pivotally mounted guides. The guides pivot in alignment with an adhesive tape roll making machines to slideably deliver the tapes cores thereto.

U.S. Pat. No. 5,074,735 discloses a wicket indexed unit for sequentially aligning individual bag stacking units with a bag transfer unit for stacking plastic bags having spaced holes along a given edge portion. A rotatable stud has a plurality of posts extending therefrom. The posts are adapted to be inserted in the holes of the the bags for removing the bags off a conveyor. The stud is then rotated to urge the bags to a desired stacking position.

U.S. Pat. No. 4,337,719 discloses a mandrel support means for use with an apparatus for cylindrical cans. The apparatus is comprised of a circular mandrel wheel having mandrel assemblies mounted transversely on a stationary central shaft. The mandrel assemblies have cam roller ends which communicate with a guiding stationary box cam. A secondary mandrel support is provided adjacent the mandrels mounted on the stationary shaft member. The stationary shaft member is comprised of one or more planar support cams which extend radially from the secondary mandrel support to cammingly engage with the mandrel assemblies.

U.S. Pat. No. 4,456,417 discloses a method and apparatus for loading, aligning and supporting hollow cylinders on a mandrel. The apparatus includes a cam for actuating a bifurcated jaw hinged on a pintle for releaseably retaining the cylinders on the mandrel. The apparatus retains the cylinders on the mandrel during a transfer to a vertical position and releases the cylinders on a seat without disrupting the linear alignment or dropping the cylinders.

Co-pending U.S. application Ser. No. 07/815,472 discloses a carbon dioxide cleaning system for cylindrical substrates. A plurality of carbon dioxide expansion chambers are coupled to an outlet end of respective nozzle. The nozzles disperse a stream of solid carbon dioxide particles to clean cylindrical substrates.

Co-pending U.S. application Ser. No. 07/933,647 discloses an automated substrate loading and photoreceptor unloading system for loading, supporting and unloading substrates and collars.

SUMMARY OF THE INVENTION

In accordance with one aspect of the present invention, there is provided an apparatus for loading a substrate into a processing module, comprising: means for processing a substrate into a processed substrate; means for supporting and transporting the processed substrate to the processing module for additional processing to form a further processed substrate; means for transferring the substrate to said processing means and for transferring the processed substrate from said processing means to said supporting and transporting means; and means for moving said transferring means from a first position to a second position, with the substrate longitudinally extending in a first direction in the first position, and longitudinally extending in a second direction in the second position of said transferring means.

Other features of the present invention will become apparent as the description thereof proceeds and upon reference to the drawings.

BRIEF DESCRIPTION OF THE DRAWINGS

In the detailed description of the preferred embodiments of the present invention, reference is made to the accompanying drawings, in which.

Figure 1:
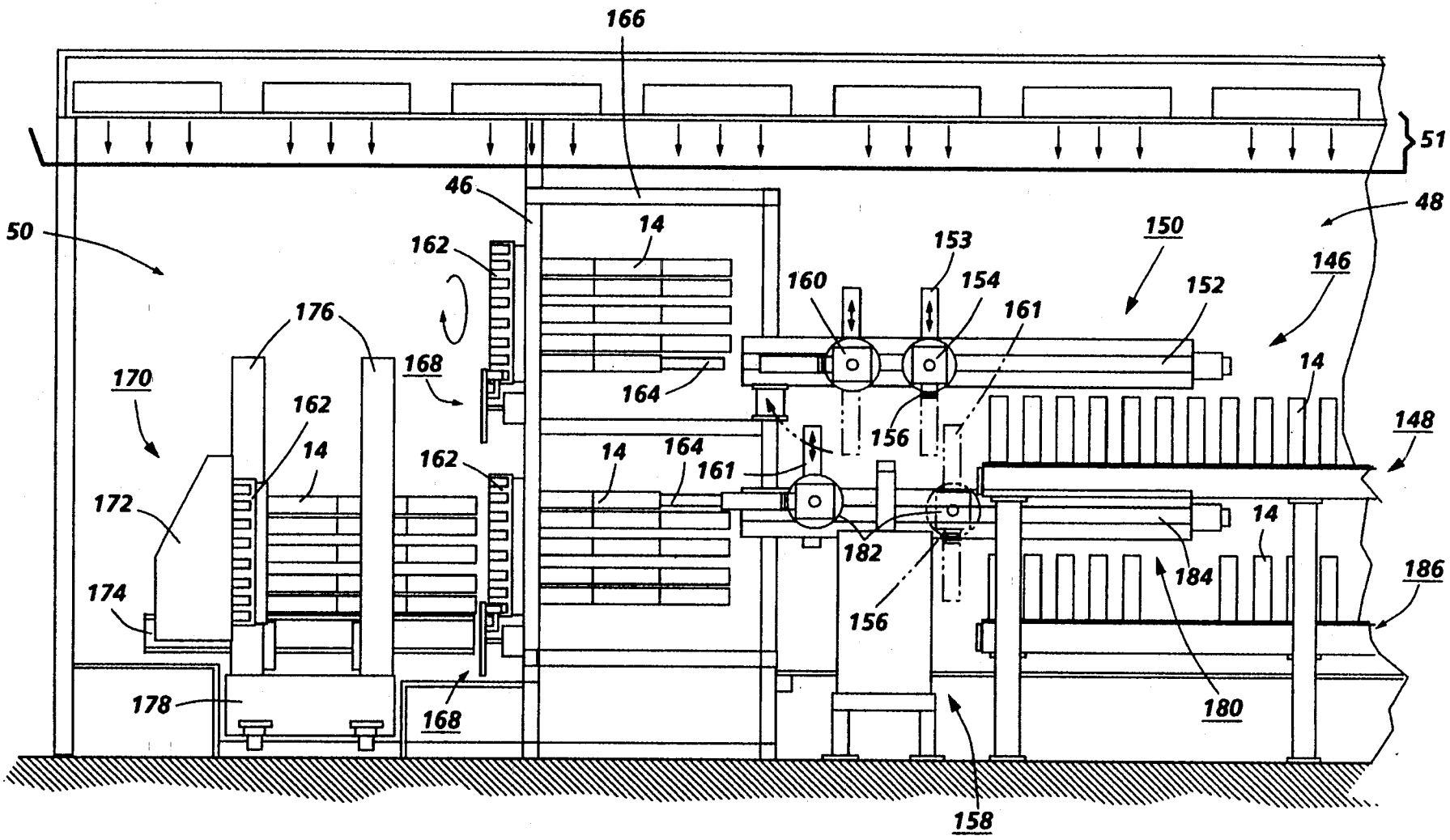
FIG. 1 is a schematic elevational view showing an illustrative automated loading and unloading system for loading and unloading members, such as substrates, incorporating the features of the present invention therein.

In the drawings and the following description, it is to be understood that like numeric designations refer to components of like function.

DETAILED DESCRIPTION OF THE PREFERRED EMBODIMENTS

The present invention provides a system for loading and unloading a member which is particularly adapted for use in the fabrication process of photoreceptors in a rotary atomization manufacturing system. Describing now the specific example illustrated in the figures, there is schematically shown in FIG. 1, an automated loading and unloading system, designated by the reference numeral 146, for loading and unloading members, and particularly adapted for loading unprocessed substrates and unloading processed substrates transformed into photoreceptors. The substrates 14 may be in the form of cylinders, sleeves, semi-rigid belts, or other suitable configurations which define an opening. A plurality of substrates 14 are positioned on a conveying system 148. The conveying system 148 transports the substrates 14 beneath a load robot 150. The load robot 150 includes suitable device for engaging and lifting at least one substrate 14 off of the conveying system 148 to retain the substrate 14 in a secure position within or on the robot 150. For example, the illustrative robot 150 of FIG. 1 includes a suitable device 153 for adjusting the height of at least one elongated load member or head 154 utilized for substrate engaging and retaining. Preferably, device 153 is a motor driven linear slide. In embodiments, device 153 may be a vertically disposed double acting piston and cylinder combination (or other suitable mechanical part(s)) connected to the load head 154 and controlled electro-mechanically, hydraulically, pneumatically or any other suitable fashion. Preferably, height adjustment of load head 154 is made by a vertically movable load head 154 in combination with an immobile carriage 152. In embodiments, however, carriage 152 can be adapted for vertical movement, with vertically movable or immobile load head 154, by coupling a suitable device such as a vertically disposed double acting piston and cylinder combination (or other suitable mechanical part(s)) to carriage 152 and controlling its vertical movement electro-mechanically, hydraulically, pneumatically or any other suitable fashion. The load head 154 includes pick-up heads 156 generally positioned at the lower end thereof. The pickup heads 156 may be in various forms, such as mechanical actuated grippers or inflatable air retaining device (such as an air bag extending from the load head 154 or an air inflatable strip wrapped about the load head 154) inflated and deflated by a (pressure valve controlled) suitable compressed air (or fluid) source. Preferably, the pick-up heads 156 engage the interior surface of the substrates 14 to diminish the probability of contamination of the exterior surface thereof. However, the engagement of the exterior surface of the substrates 14 by pickup heads 156 is another feasible alternative.

Downward movement of load head 154, carriage 152, or both, can be controlled to position the air retaining device within the substrate 14. Once positioned within substrate 14, pickup heads 156 engage the interior surface (defining the inner circumference) of at least one substrate 14 to retain substrate 14. For example, if pickup heads 156 have an air retaining device, the air retaining device will be inflatable by a suitable compressed air source connected thereto. The air retaining device is inflated until expansion against the inner surface of at least the one substrate 14 is achieved and substrate 14 is secured thereby. Load head 154 and/or carriage 152 is then raised, thus lifting up at least the one substrate 14 therewith.

Load head 154 is moved horizontally by suitable device, such as through a horizontally disposed piston functioning in a manner similar to that of the vertically disposed piston and cylinder combination, but additionally in combination with a horizontally movable slide interconnected to carriage 152. Alternatively, load head 154 could have an interconnection to a belt wrapped about a plurality of rollers rotatably driven by a motor. Load head 154 is moved horizontally until positioned above a processing apparatus for further processing. Preferably, the processing apparatus is a cleaning apparatus 158 which cleans at least the one substrate 14 prior to subsequent processing, although it should be understood that a wide variety and various numbers of processing stations could be utilized in lieu of the single cleaning station 158. Load head 154 and/or carriage 152 is then lowered until the substrate 14 is positioned within the mouth of the cleaning apparatus 158 in alignment to be received by a mandrel therein. The load position of the mandrel is preferably at the approximate elevation as the top of conveying system 148. Then, pickup heads 156 release substrate 14 and substrate 14 is then received by the mandrel of cleaning apparatus 158. The load head 154, then returns to its initial position to pick up another substrate 14.

Within cleaning apparatus 158, the substrates 14 are cleaned by any suitable technique, such as the utilization of liquid detergents, carbon dioxide, freon, or ozone with or without simultaneous exposure to ultraviolet light. In one such system, the support mandrel, retaining the substrate 14 thereon, moves the substrate 14 past a nozzle therein. The substrate 14 will be both rotated and moved axially by the support mandrel, but need not have such movement so long as the spray from the nozzle can be applied to the surface of the substrate 14. The nozzle is interconnected by a suitable flexible tubing feed line to a suitable cleaning source. For example, the cleaning source may be a valve controlled pressurized liquefied carbon dioxide tank which releases carbon dioxide therefrom through the nozzle onto the substrate 14.

As the carbon dioxide travels through the orifice and the expansion tube it expands and solidifies. The tube may be from $\frac{1}{8}$ of an inch to $1\frac{1}{2}$ of an inch in diameter, and is preferably between $\frac{1}{4}$ to $\frac{3}{4}$ of an inch in diameter, and is more preferably about $\frac{1}{2}$ inch in diameter. The expansion tube may be from 1 to 24 inches in length, and is more preferably approximately 8 inches in length between the inlet end at the nozzle and the outlet end of the expansion tube. As is known in the art, the size of the resulting solid carbon dioxide particles may be controlled by varying the length of the expansion tube.

The nozzle may comprise at least one large circumferential applying orifice and expansion tube or a plurality of orifices and expansion tubes arranged in a circumferential progression. The solid carbon dioxide particles are released from the expansion tube and are directed to the surface of the substrate 14, either at acute or perpendicular angles of incidence. A second nozzle may exist to direct a stream of dry, nonreactive gas, such as nitrogen, along the surface of the substrate 14 such that the stream of carbon dioxide particles leaving the first nozzle impacts the surface of the substrate 14 more directly. A carbon dioxide precision cleaning system is discussed in co-pending U.S. application Ser. No. 07/815,472, to Swain, filed Dec. 31, 1991, the disclosure of which is totally incorporated herein by reference thereto. In an alternative system, an associated pump could be connected to a solution tank to pump liquid cleaning detergent solution via the tubing feed line through a liquid applying nozzle onto the substrate 14.

After the substrate 14 is placed upon the support mandrel, the support mandrel will lower the substrate 14 such that the top of the substrate 14 is positioned at or below the impingement point of the nozzle. The support mandrel continually moves the substrate 14 upward and downward past the spray of the nozzle. Preferably, substrate 14 encounters the spray of the nozzle only during the upward movement of substrate 14. The vertical movement of the substrate 14 can be accomplished in a variety of ways, including utilizing a piston and cylinder combination along with an associated actuator thereof to drive the support mandrel vertically. Preferably, the vertical stroke of the support mandrel should be somewhat greater than the length of the longest substrate 14. If desired, the support mandrel may also rotate while moving vertically. This can be accomplished by utilizing a rotary piston, dual shaft piston, a camming arrangement or other suitable mechanical part(s). The positioning of the support mandrel and the stroke thereof assure that the entire substrate 14 is impacted by the spray of a cleaning compound, i.e., carbon dioxide, and cleaned thereby.

Once substrate 14 is cleaned by cleaning apparatus 158, substrate 14 is ready for further processing. At least one cleaned substrate 14 is then engaged, lifted upward, and retained by at least one second load elongated member or head 160 of load robot 150. The second load head 160 of the load robot 150 should be positioned above the cleaning apparatus 158 so that the support mandrel thereof pushes the substrate 14 into position to be received by load head 160. This reduces cycle time by eliminating additional vertical motion which would otherwise be required. The second load head 160 functions in the same manner as the first load head 154 but is preferably actuated by separate but equally functioning equipment so as to be able to move independently in both the vertical and horizontal directions from the first load head 154. Load head 160 may be located on either the same or different carriage as load head 154. In addition, however, the movement of the load head 160 is also controlled by suitable moving device, such as a rotary piston, dual shaft piston, a camming arrangement or other mechanical part(s) to achieve rotary movement thereof. The moving device reorients at least one of the load heads 154 or 160, preferably 160, from a first position to a second position. The load head 160 in the first position orienting the substrate 14 to longitudinally extend in a first direction. The load head 160 in the second position orienting the substrate 14 to longitudinally extend in a second direction, transverse to the first direction, and preferably perpendicular thereto. The load head 160 is moved horizontally until reaching a stopping position generally at an end of the load robot 150 which is adjacent a supporting structure—a substrate carrier unit 162. Simultaneously with the horizontal motion, the load head 160 is rotated changing positions from a vertical disposition to a horizontal disposition to place the substrate in alignment to be transferred to the carrier unit 162. Preferably, the horizontal and rotating motions begin simultaneously to decrease the time of operation or cycle time.

Figure 2:
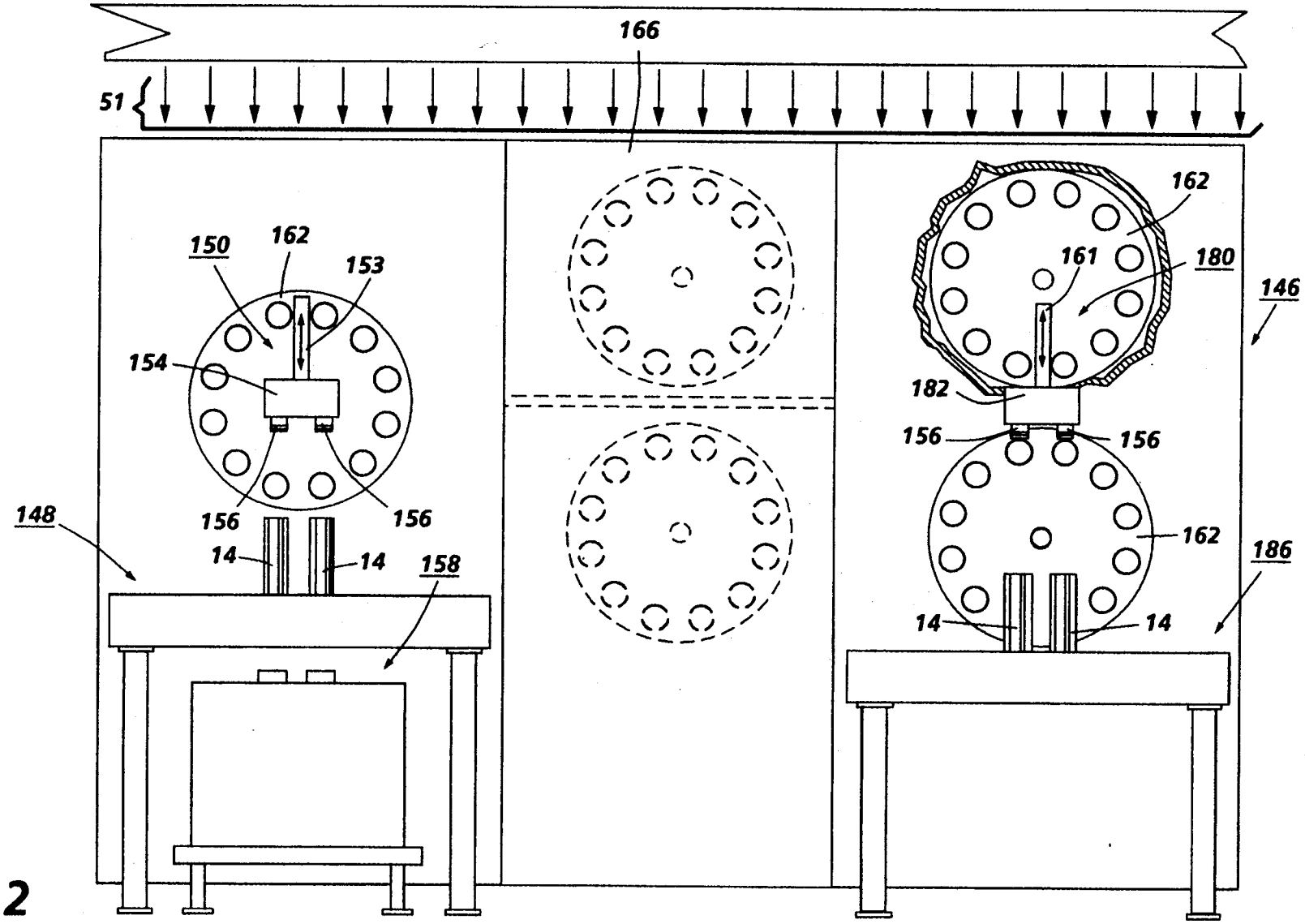
FIG. 2 is side elevational view of the FIG. 1 automated loading and unloading system with a plurality of pick up heads for each of the loading and unloading heads.

The carrier unit 162 has a plurality of mandrels 164 arranged in a planetary arrangement. The carrier unit 162 is positioned within a module of a panel 166 for temporary storage within the module until the mandrels 164 are fully loaded. The panel 166 may be an intermediate storage panel or it may be a processing panel, containing a plurality of modules having processing stations therein. A multi-module processing panel 600 is illustrated in FIG. 9 of U.S. Pat. Nos. 5,032,052 and 5,038,707 to Swain and Swain et al. respectively, the disclosure of these patents being totally incorporated herein by reference thereto. In FIG. 1, the processing panel 166 is illustrated having two modules, one above the other. However, it should be understood that a plurality of adjacent modules, hidden from view by the illustrated modules, may exist (as FIG. 2 illustrates). Likewise, it should be understood that a single module could be utilized for loading and unloading and that if separate modules are used for loading, it is not required that the loading module and the unloading module be positioned one above the other and can even be connected to separate rooms.

It is expected that at least the robots 150 and 180 will be in a separate room from the transport 170, and therefore FIG. 1 illustrates the two rooms 48 and 50. Both the rooms 48 and 50 provide laminar air flow 51 therein to prevent substrate 14 contamination that might otherwise occur. The panel 166 has one side thereof integral with a wall 46 separating the rooms 48 and 50. The wall 46 maintains atmospheric integrity between the rooms 48 and 50 to preserve contaminant particle control and pressure balance between the rooms 48 and 50. For example, a single large retractable cover or a plurality of individual smaller retractable covers could be provided for passage of the plurality of the substrates 14, preferably simultaneously.

As the substrate 14 is moved toward the module substrate carrier unit 162 by the robot 150, the horizontal momentum urges the substrate 14 substantially onto a horizontally disposed mandrel 164 of the carrier unit 162. Because of the necessary length of engagement for the pick-up heads 156 inside the substrate 14, the horizontal motion of the robot 150 cannot push the substrate 14 entirely onto the mandrels 164. A concentric, cylindrical stripper (not shown, but with an inside diameter approximately equal to the inner diameter of the substrate 14) urges the substrate 14 off of the pickup heads 156. The stripper, typically in the shape of a rectangular block is actuated by a suitable piston and cylinder to contact an end of the substrate 14 effectuating the movement thereof. The stripper moves the substrate 14 to the desired position on the mandrel 164. Then, the stripper retracts and the robot 150 returns the second load head 160 to its initial position over the cleaning apparatus 158 ready to receive the next cleaned substrate 14.

An indexing mechanism 168 assures that an unloaded mandrel is aligned with the load head 160 to receive each substrate 14. This simplifies the load robot 150 eliminating the need for the robot 150 to provide three axis motion for alignment of the load head 160 with each mandrel 164 of the carrier unit 162. The indexing mechanism includes a suitable rotary device, such as a rotary piston or motor driven gears, for rotating the carrier unit 162 to align the support mandrels thereof to receive the substrates 14 from the load robot 150. The carrier unit 162 includes a plurality of grooves arranged in a circular pattern. A generally elongated stopping member is positioned within one such groove and a rotatable cam has a generally hemisphere shaped protrusion extending therefrom into another such groove. The cam has another protrusion, which upon rotation of the cam, causes the stopping member to move out of the groove that it is positioned within allowing movement of the carrier unit 162. The rotation of the cam also causes the hemisphere protrusion to contact the surface forming the groove within the carrier unit 162 to rotatably urge the carrier unit 162, thereby, effectuating the rotation thereof.

The illustrative index mechanism 168 of the carrier unit 162 typically utilizes a "half-step/full-step" index scheme to allow for loading an empty mandrel 164 between the two loaded mandrels 164. However, a wide variety of indexing mechanisms exist and may be employed within the present invention. The "half-step" index positions a single mandrel 164 and an adjacent mandrel 164 in position for substrate 14 transfer. The subsequent "full-step" index will bring the next pair of mandrels 164 into position. This will not require any additional mechanism and will eliminate any requirement for manual changeover of the loading pitch or the indexing mechanism 168.

Once the carrier unit 162 is completely filled with the substrates 14 on the mandrels 164 thereof, the carrier unit 162 can then be withdrawn from the module of the panel 166 by a transport 170. The transport 170 functions in a manner previously understood with respect to the transport vehicle 620 illustrated and described in U.S. Pat. Nos. 5,032,052 and 5,038,707. The transport 170 has a support member 172 to which the carrier unit 162 can be detachably mounted thereto. The support member 172 is slideably mounted to a support platform 174 for horizontal movement perpendicular to the surface of the panel 166 to enable withdrawal and insertion of the carrier unit 162 into a desired module of the panel 166. The support platform 174, in turn, is slideably mounted to four vertical transport bars 176 for vertical movement. The vertical transport bars 176 are attached to a track engaging wheel base 178. The track engaging base 178 provides for horizontal movement of the carrier unit 162 parallel to the surface of the panel 166. The transport 170 engages the fully loaded carrier unit 162 and transports it to various processing stations for further processing. The transport 170 inserts the carrier unit 162 into the processing module and detaches the carrier unit 162 therefrom, thereby simultaneously transferring the substrates 14 to the module. The insertion of a carrier unit 162 and simultaneous transfer of substrates 14 into a chamber of panel 166, illustrated in FIG. 1, is typical of insertion and simultaneous transfer of substrates 14 into a processing module of the panel 166 or another processing panel. Similarly, the transport vehicle 170 can reattach to the carrier unit 162 to simultaneously remove the substrates 14 from the chamber of the panel 166 or from a processing module. If the panel 166 contains various processing stations, the transportation of the carrier unit 162 can be performed by the transport 170 in the same fashion as described in U.S. Pat. Nos. 5,032,052 and 5,038,707 with reference to the transport vehicle 620 therein. If the panel 166 functions as an intermediate storage panel, the transport 170 can transport the carrier unit 162 to the various processing stations, preferably housed within a panel of which the incorporated processing panel 600 is typical thereof.

The transfer of the substrates 14 to a processing module is not limited to insertion of the entire carrier unit 162. The transport 170 can provide that the mandrels 164 be released from the carrier unit or that the substrates 14 be urged off the mandrels 164.

As illustrated in FIG. 1, carrier unit 162 is positioned in a lower module of panel 166 for temporary storage therein. A second robot 180, similar in function to the robot 150, then removes substrates 14, now transformed into photoreceptors, in a similar manner understood with reference to the loading of substrates 14 by robot 150 into panel 166. The second robot 180 includes at least one load head 182 having pickup heads 156. The load head 182 is initially longitudinally disposed horizontally in alignment to receive at least one substrate 14 from the mandrel 164 of the carrier unit 162 disposed within the lower module of the panel 166. Preferably, carriage 184 is immobile and robot 180 includes suitable devices such as motor driven linear slides, piston and cylinder combinations or piston actuated slides to render load head 182 movable in the vertical and horizontal directions. In embodiments, load head 182 moves independently of load heads 154 and 160. Load head 182 moves horizontally towards carrier unit 162 to position load head 182 in alignment to receive at least one substrate 14 from a mandrel 164. Then, pickup head 156 engages substrate 14 in a suitable manner to retain substrate 14 on load head 182. Simultaneous with the horizontal motion, load head 182 is rotated from a horizontal position to a vertical position by a suitable rotational device, such as a rotary piston. When substrate 14 is positioned over the second conveying system 186, load head 182 is lowered and pickup head 156 of load head 182 releases the (processed) substrate 14 onto conveying system 186 for subsequent transportation to a packaging station. In the meantime, a pneumatically or electrically actuated pusher finger located in mandrel 164 moves the next substrate 14 to the outboard end of mandrel 164 to position same for engagement by load head 182. The process is perpetually repeated to provide a complete and efficient method of loading, processing and unloading of substrates 14. In embodiments, carriage 184 can be adapted for vertical and horizontal movement to facilitate positioning of pickup head 156, with movable or immobile load head 182, by coupling suitable devices such as motor driven linear slides, piston and cylinder combinations or piston actuated slides to carriage 184. It is understood that both mobile and immobile load heads may be capable of rotational movement.

The loading and unloading system 146 has hereinbefore been described as loading a single substrate 14. In embodiments, load heads 154, 160, and 182 can have two or more pickup heads 156 for simultaneous loading of a plurality of substrates and/or simultaneous unloading of a plurality of photoreceptors. Also, robot 150 can have both a plurality of closely adjacent load heads 154 and a second plurality of closely adjacent load heads 160. The closely adjacent load heads 154 would vertically lift the closely adjacent substrates 14 off of the conveying system 148. Subsequently, the load heads 154 will place the substrates 14 onto closely adjacent support mandrels 164 within a processing station. Then, the plurality of closely adjacent load heads 160 will remove the substrates 14 from the processing station, and transport the closely adjacent substrates 14 therefrom to the carrier unit 162. Also, the present invention is not limited to loading a single substrate 14 and may place a substrate 14 and a collar onto the mandrel 164 of the carrier unit 162.

FIG. 2 more clearly illustrates the engagement and retention of a plurality of closely adjacent substrates 14 by a modified loading and unloading system 146 for simultaneously loading a plurality of substrates 14. The elevational view of FIG. 1 illustrates only one pickup head for load heads 154, 160, and 182, however,these load heads 154, 160, and 182 can have a plurality of pickup heads as shown in FIG. 2 existing in alignment behind the front pickup head (of FIG. 1) for simultaneously engaging and retaining a plurality of substrates 14 in a corresponding alignment. FIG. 2 illustrates a side elevational view of such a modified system 146 in which the plurality of pickup heads 156 of robot 150 simultaneously engage the substrates 14 off of the conveying systems 148. Also shown in FIG. 2 is the simultaneous unloading of the substrates 14 by the two pickup heads 156 of load heads 182 of the second robot 180 onto the conveying system 186. From the discussion of FIG. 1 and the view of FIG. 2, it should be apparent the plurality of pickup heads 156 of load head 154 simultaneously load the plurality of closely adjacent substrates 14 into the cleaning apparatus 158; and the plurality of pickup heads 156 of load head 160 simultaneously engage and remove the plurality of substrates 14 from the cleaning apparatus 158 and then subsequently load the plurality of substrates 14 simultaneously onto the carrier unit 162.

Any suitable substrate 14 may be loaded and unloaded using the apparatus and process of this invention. A cylindrical sleeve substrate is particularly suited to be loaded, supported and unloaded by the loading and unloading system of the present invention. The substrate 14 may comprise a single layer or a plurality of layers in which the layers comprise suitable plastic and/or, metallic materials. Typical plastic materials include polyethylenes, polypropylenes, polycarbonates, polyvinylacetate, terephthalic acid resins, polyvinylchloride, styrene-butadiene co-polymers, vinyl esters and the like. Typical metallic materials include aluminum, stainless steel, brass, titanium, nickel and the like. The sleeve substrate 14 may be of any suitable thickness which will allow cleaning without collapsing or cracking. Preferred sleeve thicknesses, for use with the pick-up heads 156, can range from between about 0.1 millimeter to about 6 millimeters. Thicker substrates 14 may be utilized as long as sufficient support can be provided by the pick-up heads 156. Substrates 14 having a thickness up to about 12 centimeters may be loaded and unloaded with the process and apparatus of this invention.

The materials used to form the loading/unloading system 146 including the robots 150 and 180, and the carrier unit 162 are preferably anticorrosive materials, such as stainless steel or aluminum with teflon coating.

In an alternate embodiment, the substrate load station and substrate unload station can be combined into one station. In this embodiment, some of the stated advantages are lost but a reduction of system cost can be achieved if a reduced throughput manufacturing system is desired.

In recapitulation, it is evident that the automated loading and unloading system of the present invention employs a robot which engages and retains cylindrical or sleeve-like substrates and collars and transfers the substrates to cleaning processing module within the system. The robot engages the processed substrates from the processing module and transfers the processed substrates to support structure, which in turn transfers the processed substrates to a processing module for further processing. The robot utilizes a plurality of load heads for engaging and retaining the substrates at least one of which moves from a first position to second position to reorient the substrates for alignment with the support structure. The loading and unloading system of the present invention provides for an efficient manufacturing system, particularly a rotary manufacturing system. The loading and unloading systems eliminates a processing station and its associated cost within the manufacturing system without adversely affecting the loading time. In addition, by eliminating manual loading of the carrier unit, a contaminant free environment can be more readily achieved and maintained.

What is claimed is:

1. An apparatus for loading a substrate defining an opening into a processing module, comprising:

means for processing a substrate defining an opening into a processed substrate defining an opening;

means for supporting and transporting the processed substrate to the processing module for additional processing to form a further processed substrate defining an opening, wherein said supporting and transporting means includes a plurality of spaced apart elongated members for receiving a plurality of substrates, and wherein said plurality of elongated members all extend in the same direction;

means for transferring the substrate defining the opening to said processing means and for transferring the processed substrate defining the opening from said processing means to said supporting and transporting means, wherein said transferring means comprises a first load member means for transferring the substrate to said processing means and a second load member means for transferring the processed substrate from said processing means to said supporting and transporting means; and means for moving said transferring means from a first position to a second position, with the processed substrate defining the opening longitudinally extending in a first direction in the first position, and longitudinally extending in a second direction in the second position of said transferring means.

2. The apparatus according to claim 1, wherein said processing means cleans the substrate forming a clean substrate.

3. The apparatus according to claim 1, wherein the longitudinal axis of the processed substrate in the first position of said transferring means extends in a substantially vertical direction.

4. The apparatus according to claim 1, wherein the longitudinal axis of the processed substrate in the second position of said transferring means extends in a substantially horizontal direction.

5. The apparatus according to claim 1, wherein the longitudinal axis of the processed substrate in the first position of said transferring means extends in a direction substantially perpendicular to the longitudinal axis of the processed substrate in the second position of said transferring means.

6. The apparatus according to claim 1, wherein said moving means pivotally moves said transferring means from the first position to the second position.

7. The apparatus according to claim 1, wherein said supporting and transporting means comprises an indexing mechanism.

8. The apparatus according to claim 1, further comprising conveying means for transporting the substrate to said transferring means.

9. The apparatus according to claim 1, wherein said supporting and transporting means removes the further processed substrate from the processing module.

10. The apparatus according to claim 9, wherein said transferring means removes the further processed substrate from said supporting and transporting means.

11. The apparatus according to claim 1, wherein said first load member means and said second load member means move independently of one another.

12. The apparatus according to claim 1, wherein said supporting and transporting means removes the further processed substrate from the processing module and said transferring means comprises a third load member means for removing the further processed substrate from said supporting and transporting means.

13. The apparatus according to claim 12, wherein said third load member means moves independently of said first load member means and said second load member means.

14. The apparatus according to claim 1, wherein said transferring means simultaneously transfers the substrate and a second substrate to said processing means; and said transferring means simultaneously transfers the processed substrate and the processed second substrate from said processing means to said supporting and transporting means.

* * * * *